US012768342B2

(12) United States Patent
Bubb et al.

(10) Patent No.: US 12,768,342 B2
(45) Date of Patent: Oct. 20, 2026

(54) OSCILLATING METERING PUMP

(71) Applicant: ProMinent GmbH, Heidelberg (DE)

(72) Inventors: Alexander Bubb, Plankstadt (DE); Christian Arnold, Weinheim (DE)

(73) Assignee: ProMinent GmbH, Heidelberg (DE)

( * ) Notice: Subject to any disclaimer, the term of this patent is extended or adjusted under 35 U.S.C. 154(b) by 0 days.

(21) Appl. No.: 19/079,707

(22) Filed: Mar. 14, 2025

(65) Prior Publication Data

US 2025/0290494 A1 Sep. 18, 2025

(30) Foreign Application Priority Data

Mar. 18, 2024 (DE) ..... 10 2024 107 666.6

(51) Int. Cl.
*F04B 13/00* (2006.01)
*F04B 49/12* (2006.01)

(52) U.S. Cl.
CPC ..... *F04B 13/00* (2013.01); *F04B 49/12* (2013.01)

(58) Field of Classification Search
CPC .. F04B 13/00; F04B 49/12; F04B 7/06; F04B 49/06; F04B 2201/0201; F04B 43/12;
(Continued)

(56) References Cited

U.S. PATENT DOCUMENTS 4,930,991 A * 6/1990 Bonneyrat ..... F04B 13/00 417/18
6,119,973 A * 9/2000 Galloway ..... B65H 54/2812 242/920

(Continued)

FOREIGN PATENT DOCUMENTS

DE 602004007247 T2 2/2008

OTHER PUBLICATIONS

Search Report dated Feb. 12, 2025 in German Application No. 10 2024 107 666.6 (with English translation).

*Primary Examiner* — Mark A Laurenzi
*Assistant Examiner* — Benjamin Doyle
(74) *Attorney, Agent, or Firm* — SALIWANCHIK, LLOYD & EISENSCHENK

(57) ABSTRACT

A metering pump for conveying fluids, with a metering head in which a metering chamber is arranged, a displacement element that can be moved back and forth between a first position and a second position on a movement axis, and a drive that rotates around a rotation axis, whereby a rotation movement of the drive around the rotation axis is converted into an oscillating movement of a connecting rod by a gear arrangement. The connecting rod is connected to the displacement element in such a way that the displacement element is moved back and forth along the movement axis, whereby the drive performs a pendular movement with a twist angle of $\alpha<360°$ and a frequency f during the operation of the metering pump, and the gear arrangement comprises a cam 10 gear that is arranged on the rotation axis and has a curved running surface that deviates at least in sections from a circular path around the rotation axis, with the connecting rod rolling over a roller on the running surface, so that a stroke length of the displacement element is determined by the twist angle $\alpha$ and a slope of the running surface and a stroke frequency of the displacement element is determined by the frequency f.

17 Claims, 8 Drawing Sheets

(58) Field of Classification Search
CPC ..... F04B 39/0094; F04B 2201/1208; F04B 2201/0202; F04B 19/22; F04B 1/0413
USPC ..... 417/212; 74/20, 21, 99 R, 25, 18.2, 88, 74/89
See application file for complete search history.

(56) References Cited

U.S. PATENT DOCUMENTS

| | | | | |
|---|---|---|---|---|
| 6,230,862 | B1 * | 5/2001 | Reik | B60W 10/11 192/3.56 |
| 6,555,985 | B1 * | 4/2003 | Kawabata | H02P 8/38 318/434 |
| 2005/0244276 | A1 * | 11/2005 | Pfister | F04B 9/02 417/12 |
| 2007/0041845 | A1 * | 2/2007 | Freudenberger | F04B 13/00 417/63 |
| 2012/0097025 | A1 * | 4/2012 | Fritsch | F04B 49/126 92/140 |
| 2013/0101439 | A1 * | 4/2013 | Freudenberger | F04B 49/02 417/44.11 |

* cited by examiner

OSCILLATING METERING PUMP

CROSS-REFERENCE TO RELATED APPLICATION

This application claims the benefit of German Application No. 10 2024 107 666.6, filed Mar. 18, 2024, the disclosure of which is incorporated by reference herein in its entirety.

The present invention relates to a metering pump for conveying a metering volume of a fluid, with at least one metering head in which a metering chamber is arranged, a displacement element that can be moved back and forth between a first position and a second position on a movement axis, wherein the displacement element delimits the metering chamber and the volume of the metering chamber in the first position of the displacement element is larger than the volume of the metering chamber in the second position of the displacement element, and a drive that rotates about a rotation axis, wherein a rotation movement of the drive about the rotation axis is converted by a gear arrangement into an oscillating movement of a connecting rod during operation of the metering pump. The connecting rod is connected to the displacement element in such a way that the displacement element is moved back and forth between the first and second positions along the movement axis.

Furthermore, the present invention relates to a metering process for conveying a metering volume of a fluid, in particular a process for operating a metering pump of the type described above, wherein a rotation movement of a drive is converted into a stroke movement of a displacement element by means of a gear arrangement.

Various designs of metering pumps are known in the art. A large proportion of the applications for metering pumps involve setting, controlling or regulating a specific metering volume of a fluid to be conveyed, for example in order to supply a fluid to a process in a temporally defined sequence.

Metering pumps of this kind are often used, for example, to meter chemicals. To enable the fluid to be metered, a metering head is provided with a displacement element that can be moved back and forth between a first and a second position and that delimits a metering chamber.

Typically, the metering chambers of metering pumps also have a fluid outlet through which fluid absorbed in the metering chamber is transported out of the metering head. The transportation out of the metering head is achieved by a reduction in the volume of the metering chamber, which is also referred to as a pressure stroke and in which the displacement element is moved into the second position.

If a metering pump is operated with only one fluid outlet, it can be used as a pulsator, for example to drive extraction columns.

In most cases, however, the metering head also has a fluid inlet through which the fluid to be conveyed is sucked into the metering chamber while the displacement element is moved to the first position, thus increasing the volume of the metering chamber. This is also known as the suction stroke.

In this way, a metering pump can be used to deliver a fluid, wherein the fluid is sucked in through the fluid inlet when the volume of the metering chamber increases and transported out through the fluid outlet when the volume of the metering chamber decreases. Accidental backflow of the fluid is inhibited by appropriately arranged check valves.

A membrane, for example, can be used as the displacement element. Alternatively, the displacement element can also be a piston.

The displacement element is moved by a drive, which can be a motor or part of a motor, for example. Rotating electric motors are often used as drives in metering pumps, in which a rotating movement around a rotation axis is converted into a linear movement of the displacement element between the first and second position. A gear arrangement is provided for this purpose, which is connected to the displacement element by a connecting rod. The connecting rod performs a sinusoidal movement.

The metering volume of the fluid that can be delivered by a metering pump essentially corresponds to the change in volume of the metering chamber between the first and second position of the displacement element. Various solutions are known in the art for adjusting the metering volume of a fluid that can be delivered by a metering pump in a certain time.

One solution, for example, is to change the frequency with which the displacement element is moved back and forth between the first and second position, which changes the metering volume that is delivered per unit of time. In the simplest case, the speed of the motor is changed accordingly. However, the motor speed cannot be adjusted arbitrarily, so this method is not suitable for every application. For example, processes that require good mixing of the fluids to be conveyed cannot be realized with a low metering frequency.

Alternatively, the stroke length of the displacement element, i.e. the distance between the first and second position, can be changed to adjust the change in volume in the metering chamber and thus the metering volume. In the case of metering pumps that work with a rotating drive, this is usually implemented by means of an additional stroke length adjustment that is provided independently of the drive. This stroke length adjustment, which is known in the art, is a mechanical adjustment of the stroke length, e.g. by means of a mechanically adjustable stroke-adjusting spindle, which delimits the backward movement of the connecting rod during the suction stroke. However, such an additional mechanical adjustment option for the stroke length makes the pump design more expensive and more complicated and makes it more difficult for the user of the metering pump to adjust the metering volume. Furthermore, the above-mentioned stroke adjustment spindles have the disadvantage that an optimal metering process of the fluid is only achieved at full stroke length, at which the connecting rod performs a sinusoidal movement. If the movement of the connecting rod is limited by a mechanical device, the sinusoidal movement of the connecting rod is cut off. This results in a so-called phase cut, which leads to shock pressures and pulsations in the metering pump and in the metering system. In addition, such metering pumps usually require an additional expensive return spring to perform the backward movement of the displacement element during the suction stroke.

Furthermore, it is known in the art to operate a metering pump with a linear motor whose start and end position, which are in connection with the first and second position of the displacement element, are to be set according to the desired stroke length adjustment. At the same time, the frequency of the linear motor can be adjusted. However, metering pumps with linear motors are associated with high costs.

BRIEF SUMMARY OF THE INVENTION

The present invention is therefore based on the problem of providing a metering pump or a metering process for conveying a metering volume of a fluid, by means of which the metering volume can be controlled with simple means without additional mechanical adjustments to the metering pump.

The problem is solved by a metering pump of the type mentioned above, wherein during operation of the metering pump, the drive performs a pendular movement with a twist angle of $\alpha<360°$ and a frequency f, and wherein the gear arrangement comprises a cam gear that is arranged on the rotation axis and has a curved running surface that deviates, at least in sections, from a circular path around the rotation axis, the connecting rod rolls over a roller on the running surface, so that a stroke length of the displacement element is determined by the twist angle $\alpha$ and a slope of the running surface and a stroke frequency of the displacement element is determined by the frequency f.

A pendular movement in the sense of the present invention is a rotation movement around the rotation axis with a twist angle of less than 360°. In other words, the drive of the metering pump according to the invention does not perform a full rotation, but changes the direction of rotation around the rotation axis.

The slope of the running surface is defined as the quotient of the twist angle $\alpha$ and the stroke length "h" that the displacement element covers for a twist angle $\alpha$, i.e. the distance between a start twist angle $\alpha_0$ and an end twist angle $\alpha_{end}$ on the movement axis. In particular, the stroke length "h" corresponds to a deviation "e" of the curved running surface at the twist angle $\alpha$ from a circular path around the rotation axis, the origin radius $r_0$ of which is defined by a distance between the running surface and the rotation axis at the start twist angle $\alpha_0$.

Due to the pendular movement of the drive according to the invention, the movement frame of the displacement element on the movement axis, i.e. the stroke length, depends on the twist angle of the drive around the rotation axis as well as the slope or deviation of the curved running surface from a circular path around the rotation axis.

The larger the deviation e of the curved running surface from the circular path with the origin radius r0, the larger the distance of movement of the displacement element along the movement axis. If the deviation e increases with the twist angle, i.e. if the curved running surface rises relative to the rotation axis, the stroke length of the displacement element is increased when a larger twist angle is set. This also increases the metering volume to be conveyed. Similarly, the metering volume is reduced when the twist angle is reduced.

At the same time, the metering volume delivered per unit of time can be adjusted by the frequency f at which the drive performs the pendular movement. The metering volume, which is determined by the stroke length and the stroke frequency, can thus be controlled solely by the drive. It is no longer necessary to adjust the stroke length mechanically independently of the motor control. Both the stroke length and the stroke frequency are influenced solely by the motor control. This simplifies the pump design and reduces manufacturing costs.

Individual metering profiles can be created by means of any complicated curve shapes, which may also be composed of different slopes, depending on which curve shape is selected for the running surface and in which section of the curved running surface the roller is rolling. In one embodiment, the curved running surface therefore has different slopes. The curved running surface thus follows a free, arbitrarily selectable curve shape. The slope of the running surface section in which the roller rolls according to the set twist angle $\alpha$ determines the stroke length. Optimization of the curve contour of the running surface can influence the metering speed and pulsation of the fluid, as well as the acceleration, the drive torque and the roller load of the drive. This also has a positive effect on the service life of the drive.

This individual setting, in particular of a uniform metering process, can be realized for all adjustable stroke lengths. There is no phase cut at reduced stroke length. A uniform, sinusoidal connecting rod movement is ensured for all stroke lengths.

In one embodiment, the twist angle is $\alpha\leq180°$ and, preferably, $\alpha\leq120°$. The advantage of a smaller twist angle is that, depending on the application, less powerful and thus more cost-effective drives can be used. The larger the maximum possible twist angle, the higher the motor speed must be. However, the motor torque no longer behaves linearly with increasing speed and decreases with increasing speed, so that for larger twist angles, motors must be selected that still have a sufficiently constant torque at high speeds to provide the desired delivery rate.

The advantage of a larger twist angle is a more favorable load on the roller, since a larger rotation is performed and thus the roller is not only subjected to force in a small area. In addition, a full suction and pressure stroke of the displacement element or the connecting rod can be carried out during only one direction of rotation of the drive, thus reducing energy consumption, the load on the drive and the number of direction changes. For this purpose, the curved running surface is preferably designed to be mirror-symmetrical about a mirror axis that is perpendicular to the rotation axis, so that the curved running surface has the same deviation from the circular path for a starting twist angle $\alpha_0$ as for an end twist angle $\alpha_{end}$.

In another embodiment, the slope of the curved running surface is constant, wherein the running surface is defined in particular by a circular path around a center, wherein the center differs from the rotation axis. In other words, the running surface is arranged eccentrically to the rotation axis.

In a further embodiment, the cam gear is designed as a disc, wherein the disc has a groove that comprises the curved running surface, so that the connecting rod is guided in the groove via the roller, the groove preferably being closed. Guiding the connecting rod over a roller in a curved, preferably closed groove offers the advantage that both a force for pushing the connecting rod in the pressure stroke and a force for pulling the connecting rod in the suction stroke can be transmitted through the disc. Additional pretensioning means for pushing back the connecting rod during the suction stroke are thus not required.

During the pressure stroke, the connecting rod is pushed by the roller from an inner running surface of the groove, which is closer to the rotation axis than an outer running surface of the groove, in the direction of the second position, while during the suction stroke the connecting rod is pulled by the roller from the outer running surface in the direction of the first position. In other words, both the suction stroke and the pressure stroke are force-controlled by the groove guide of the drive.

In addition, the roller is guided on both sides between the two running surfaces of the groove. Due to the only linear contact, the power transmission is delimited. Lubrication can be dispensed with if low-maintenance roller bearings are used.

Another advantage of a flat disc is that it requires less installation space. Furthermore, a disc is characterized by a low weight and a low mass moment of inertia, which is advantageous for the pendular movement of the drive.

In a further embodiment, an arc length of the groove is defined by an opening angle $\beta$ around the rotation axis, wherein $\alpha \leq \beta$. Preferably $\beta \sim \alpha_{max} + \Delta$ applies, wherein A is in the range from 2° to 5° and $\alpha_{max}$ describes the maximum twist angle that the pendular movement of the drive performs. This ensures that the change in the direction of rotation of the drive is controlled electronically and that the roller does not strike the ends of the groove, which could cause damage to the drive.

In a further embodiment, the curved running surface has at least two sections, preferably three sections, wherein at least two sections of the curved running surface have a different slope. The different slope can be used to set a specific metering profile.

In particular, a first section and a third section of the curved running surface have a smaller slope than a second section, which is arranged in the circumferential direction with respect to the rotation axis between the first and third section. Preferably, the slope in the first and/or third section is almost 0. This results in stabilizing sections with little or no slope at the beginning and end of the pump stroke and a larger slope operating range in which the majority of the metering volume is delivered. This way, a particularly smooth delivery of the fluid can be achieved by avoiding shock pressures and pulsations.

In a further embodiment, a slope of the running surface is selected such that for a movement of the connecting rod along the movement axis of $h_1$=1 mm, a slope angle $$\alpha_{h1} = \frac{\alpha}{h1}$$

is between 5° and 360° and preferably $8° \leq \alpha_{h1} \leq 90°$. On the one hand, the metering speed and metering volume can be influenced by a certain slope of the curved running surface, but also the acceleration, the drive torque and the roller load of the drive. The slope angle determines the increase in force or torque in the drive. The larger the slope angle, the smaller the increase in force and thus the lower the load on the drive, while at the same time the fluid speed in the metering chamber and the metering system is lower.

In a further embodiment, the disc has a plurality N of, preferably closed, grooves, each comprising a curved running surface that deviates, at least in sections, from a circular path around the rotation axis, wherein particularly preferably N={2, 3, 4}, and wherein the grooves are particularly preferably arranged around 360°/N in a mirror-inverted manner with respect to the rotation axis.

In particular, in a further embodiment, the metering pump has a plurality of metering heads, each with a metering chamber and a displacement element, wherein a plurality M of connecting rods is provided, wherein one displacement element in each case is connected to one of the grooves via a connecting rod, in particular M=N applies in one embodiment. With the drive according to the invention, several metering heads can therefore be operated simultaneously. The metering heads preferably work in opposing cycles. That is, if, for example, one of the displacement elements is performing a pressure stroke, another displacement element can perform a suction stroke at the same time, so that fluid is delivered without pulsation.

In a further embodiment, the drive is a controllable drive, preferably an electronically controllable drive and particularly preferably a stepper motor or a brushless DC motor. These types of motor are particularly suitable for the required change of direction and the execution of partial circular movements during the pendular movement of the drive according to the invention.

In a further embodiment, the gear arrangement has a reducing gear that is arranged between the drive and the cam gear. This allows a torque of the drive to be increased or a rotation speed to be reduced.

In another embodiment, the running surface of the cam gear is coated with a sliding coating. This additionally reduces the friction between the connecting rod and the running surface to minimize wear.

The problem underlying the invention is also solved by a metering process of the type mentioned above, wherein the rotation movement of the drive is a pendular movement with a twist angle of $\alpha < 360°$ and a frequency of f and the gear arrangement comprises a cam gear that is arranged on a rotation axis of the drive and has a curved running surface that deviates at least in sections from a circular path around the rotation axis, wherein a connecting rod rolls over a roller on the running surface, wherein the connecting rod is connected to the displacement element in such a way that a stroke length of the displacement element is determined by the twist angle $\alpha$ and a slope of the running surface, and a stroke frequency of the displacement element is determined by the frequency f.

In summary, the present invention makes it possible to control the metering volume both by changing the stroke length and by changing the stroke frequency solely through the motor control. Additional means, such as for adjusting the stroke length, are not required.

Further advantages, features and possible applications of the present invention will become apparent in the following description of embodiments and the associated figures.

DETAILED DISCLOSURE OF THE INVENTION

Figure 1:
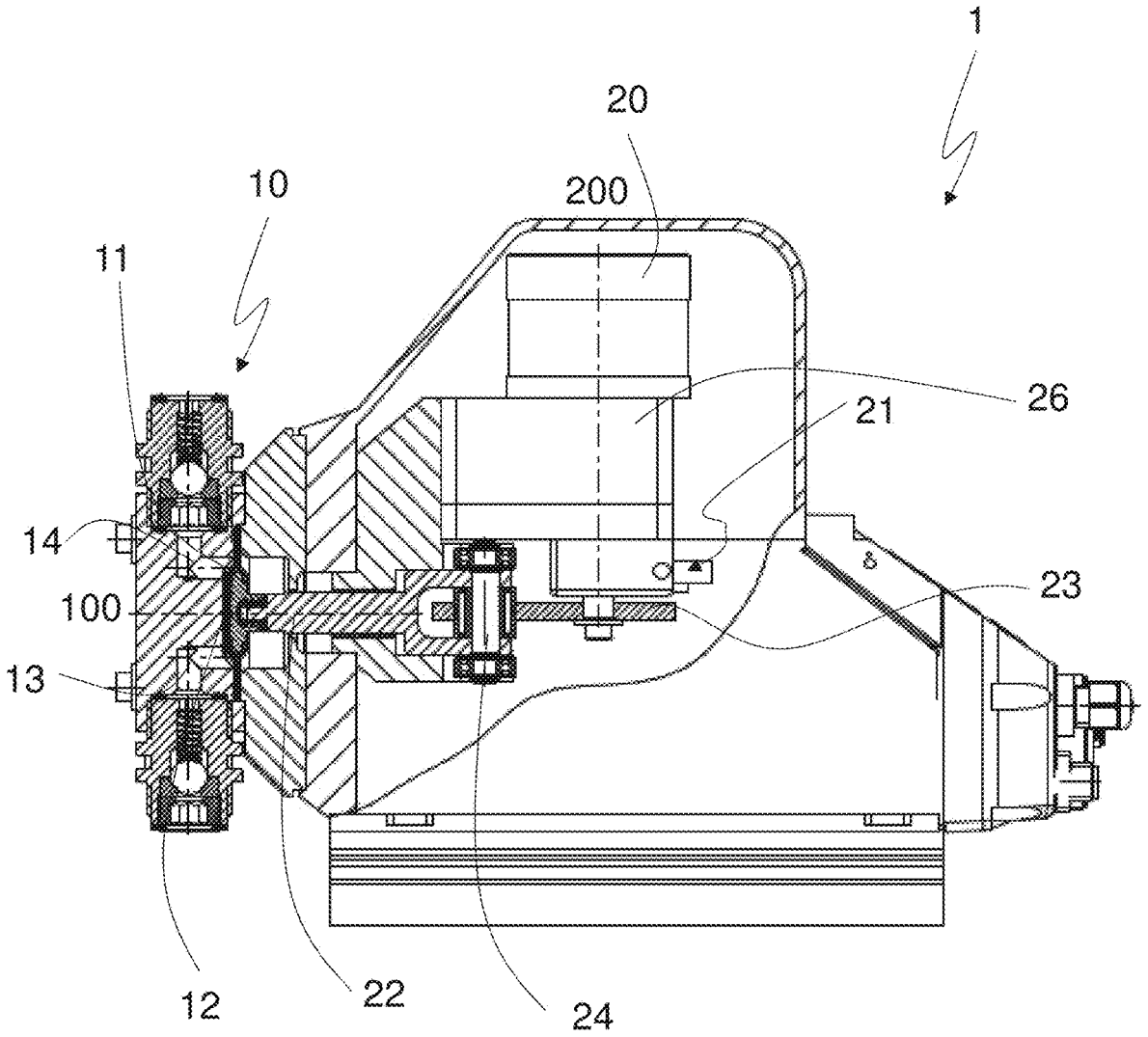
FIG. 1 shows a schematic representation of an embodiment of the metering pump according to the invention.
Figure 2:
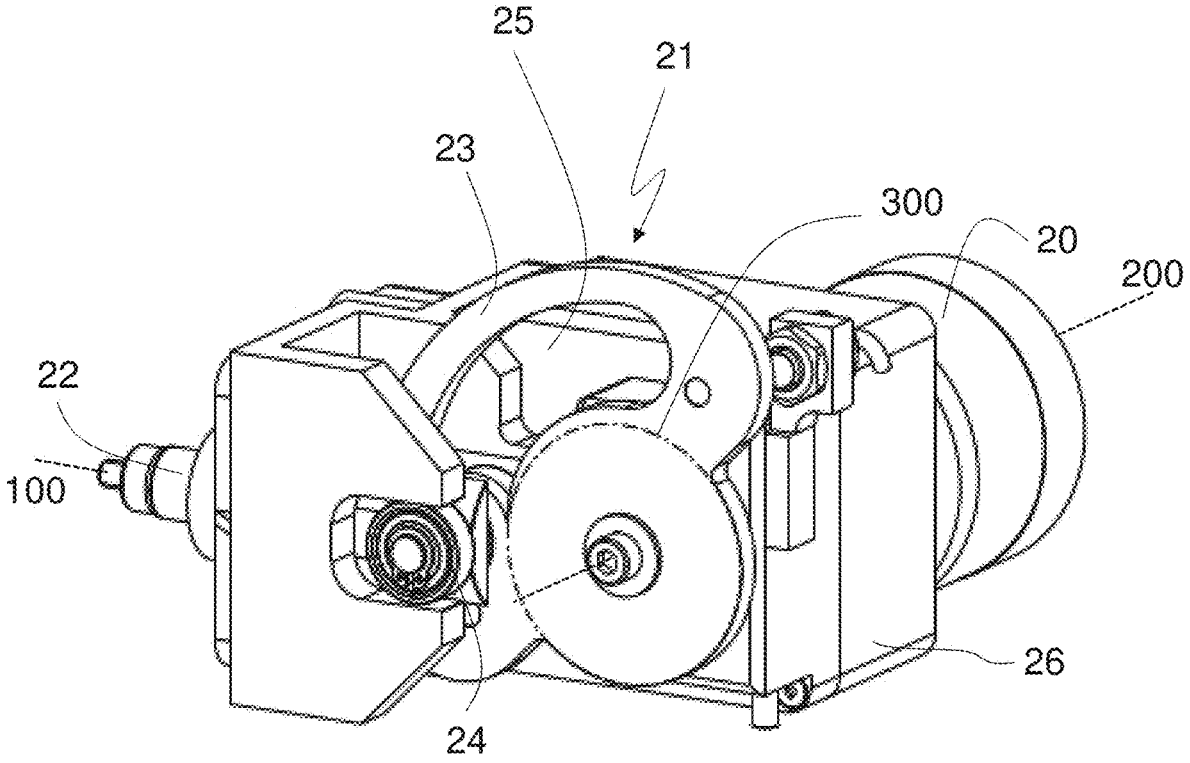
FIG. 2 shows a three-dimensional representation of the drive unit of the metering pump embodiment shown in FIG. 1.
Figure 3:
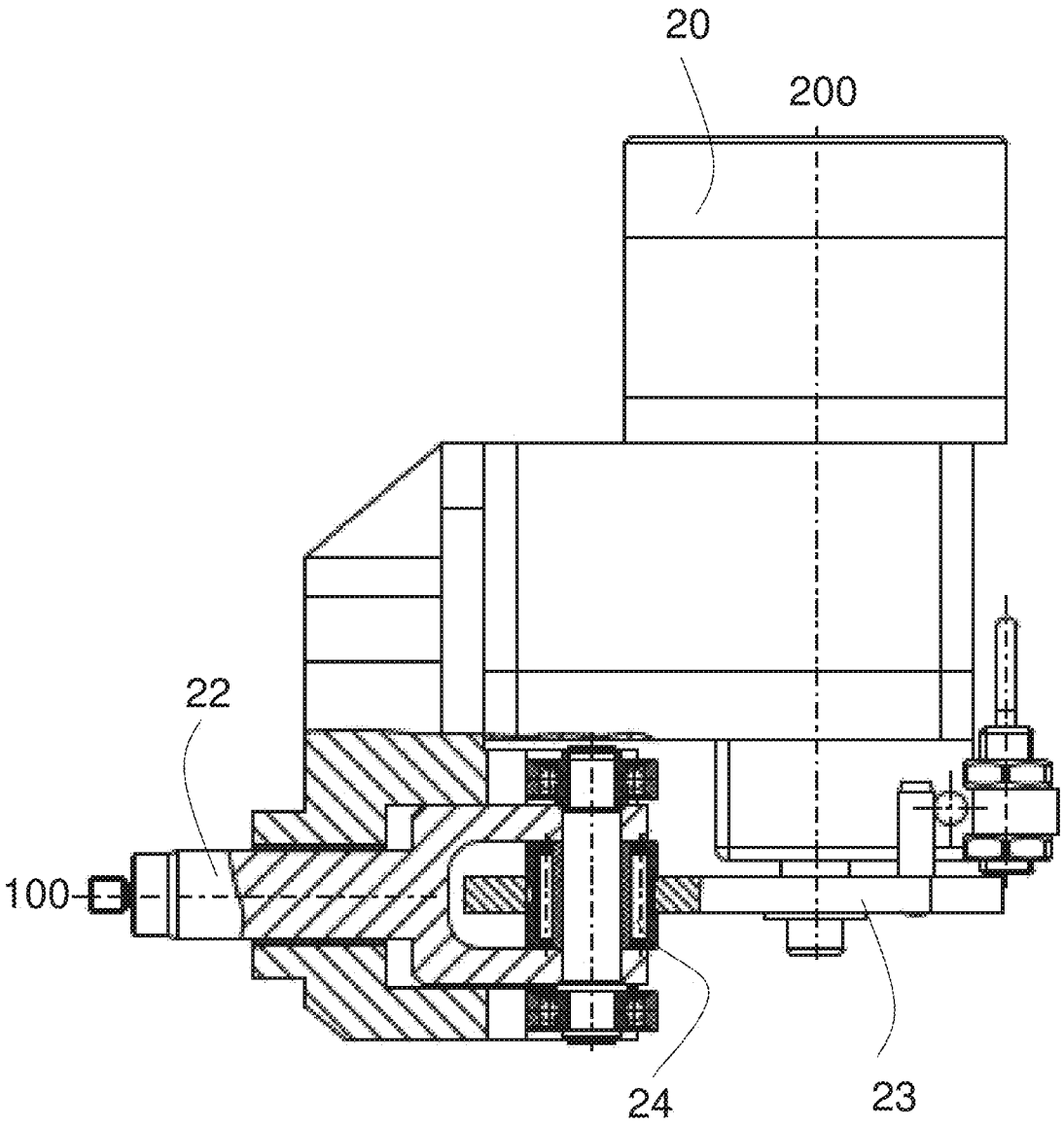
FIG. 3 shows a schematic cross-section of the drive unit shown in FIG. 2 in a plane that is spanned by the movement axis and the rotation axis.

The embodiment of the metering pump according to the invention, as shown in FIG. 1, has a metering head 10 for conveying a metering volume of a fluid, in which a metering chamber 11 is arranged. The metering chamber 11 is delimited by a displacement element 12, which can be moved back and forth on a movement axis 100 between a first position and a second position. The volume of the metering chamber 11 in the first position of the displacement element 12 is larger than in the second position of the displacement element 12, with the second position of the displacement element 12 being shown in FIG. 1.

Metering chamber 11 also has a fluid inlet 13 and a fluid outlet 14, via which the fluid to be conveyed is sucked into and forced out of metering chamber 11. For this purpose, the displacement element 12 is moved back and forth between the first and second position on the movement axis 100.

A rotating drive 20, which rotates about a rotation axis 200, is provided to move the displacement element 12 back and forth between the first and second position. During operation of the metering pump 1, the rotation movement of the shaft of drive 20 around the rotation axis 200 is converted by a gear arrangement 21 into an oscillating movement of a connecting rod 22, which is connected to the displacement element 12.

The rotating drive 20 is designed in such a way that it performs a pendular movement with a twist angle $\alpha$, thereby moving the connecting rod 22 back and forth. The reciprocating movement of the displacement element 12 thus depends on the pendular movement of the drive 20 and on the design of the gear arrangement 21. The stroke length of the displacement element 12 is determined by the twist angle $\alpha$ and the design of a running surface 230, 231 of the gear arrangement 21, while the stroke frequency of the displacement element 12 is determined by the frequency f of the pendular movement of the drive 20.

Details of the design of the drive unit of the metering pump according to the invention can be found in FIGS. 2 to 8. In particular, it can be seen from FIG. 2 that the gear arrangement 21 comprises, in addition to a reducing gear 26, a cam gear 23 in the form of a disc which is arranged on the rotation axis 200. The disc has a groove 25 that comprises curved running surfaces 230, 231, on which the connecting rod 22 is guided via a roller 24. The curved running surfaces 230, 231 deviate, at least in some sections, from a circular path 300 around the rotation axis 200.

Figure 4A:
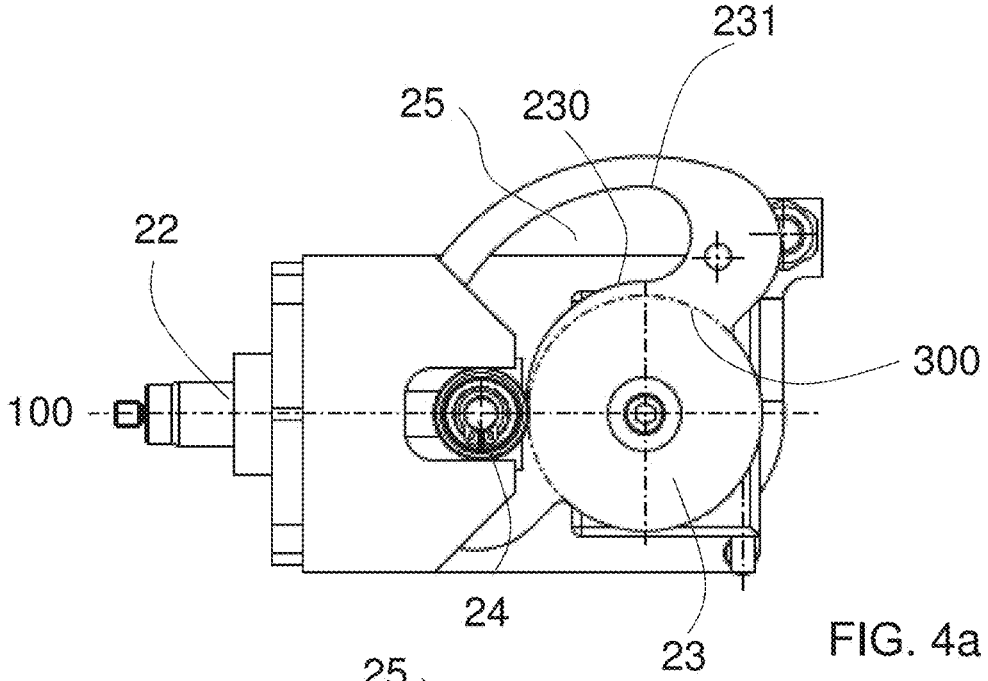
FIG. 4*a* shows a schematic side view of the drive unit shown in FIG. 2 in a starting position of the cam gear for a pressure stroke.
Figure 4B:
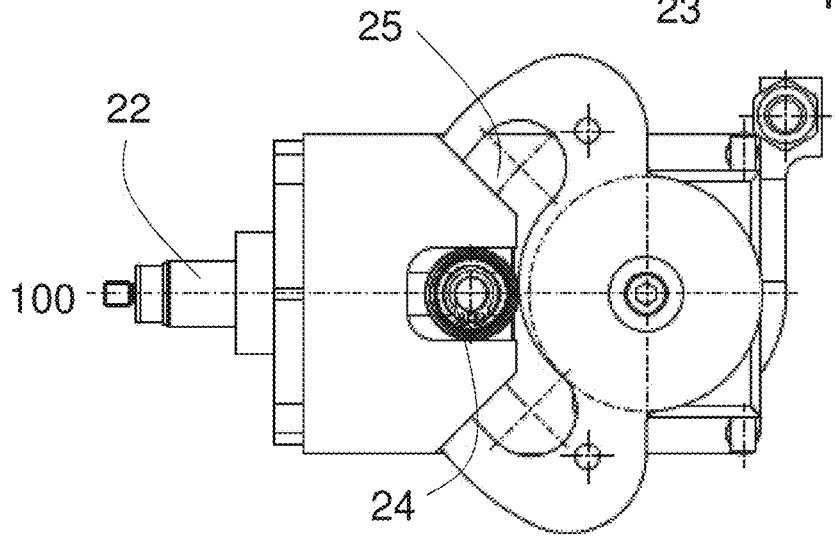
FIG. 4*b* shows a schematic side view of the drive unit shown in FIG. 2 in a center position of the cam gear for a pressure stroke.
Figure 4C:
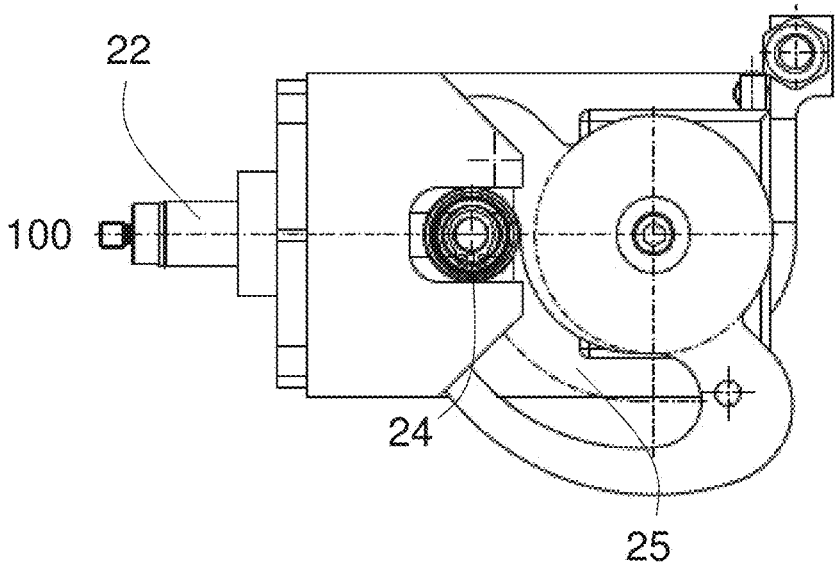
FIG. 4*c* shows a schematic side view of the drive unit shown in FIG. 2 in an end position of the cam gear for a pressure stroke.

The sequence of movements of the metering pump 1 according to the invention is illustrated by means of FIGS. 4*a*, 4*b* and 4*c*. In a starting position, which is shown in FIG. 4*a*, the roller 24 is located at a first end of the groove 25, with the connecting rod 22 being retracted in this position in the direction of the image to the right. This position of the connecting rod 22 corresponds to the first position of the displacement element 12. FIG. 4*b* shows a center position of the cam gear 23, in which the roller 24 is located in the center of the groove 25 and the connecting rod 22 has been moved to the left in the direction of the figure. FIG. 4*c* shows an end position of the cam gear 23, in which the connecting rod 22 is completely deflected to the left in the direction of the figure. This representation corresponds to the second position of the displacement element 12.

The temporal sequence of FIGS. 4*a* to 4*c*, i.e. a rotation of the cam gear 23 in an anticlockwise direction, thus represents a pressure stroke in the sense of the present invention. To draw fluid into the chamber, the movement sequence is in the opposite direction, i.e. in the order of FIGS. 4*c*-4*a*, or by turning the cam gear 23 clockwise.

Figure 5A:
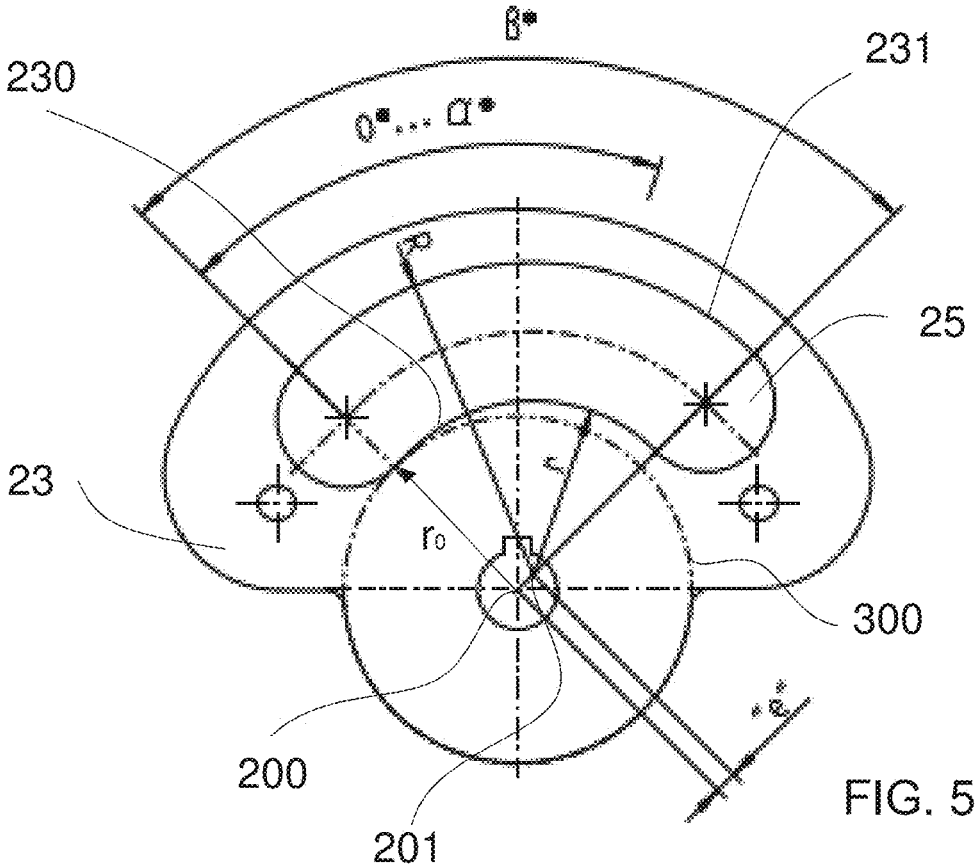
FIG. 5*a* shows a schematic representation of the cam gear of the first embodiment of the metering pump according to the invention.

FIGS. 5*a*, 5*b*, 6*a*, 6*b*, 7 and 8 show various embodiments for a cam gear 23 of the metering pump 1 according to the invention. FIG. 5*a* shows the cam gear 23 which has already been depicted in FIGS. 1 to 4*c*.

The cam gear 23 in FIG. 5*a* has a groove 25 with an arc length $\beta$. An inner running surface 230 of the groove 25 shown in FIG. 5*a* is described by a circular path with a radius r, the center 201 of which deviates by a deviation e from a center of a circular path 300, i.e. the rotation axis 200, whose radius $r_0$ is defined for a start twist angle $\alpha_0$. An outer running surface 231 of the groove 25 is described by a circular path with a radius R, the center of which also deviates from the center of the circular path 300 by a deviation e. The pendular movement of the drive 20 is limited by the cam gear 23 to an adjustable twist angle $\alpha \leq \beta$, where an arc length of $\beta=90°$ is shown in FIG. 5*a*.

During the pressure stroke, i.e. when the cam gear 23 is turned counterclockwise around the rotation axis 200, force is transmitted vithe inner running surface 230 of the groove 25, which is marked with the radius r. Conversely, during the suction stroke, i.e. a clockwise movement around the rotation axis 200, the outer running surface 231 with a larger radius R pulls the roller 24 back to the starting position. This means that an additional return spring for the connecting rod 22 is not required.

Figure 5B:
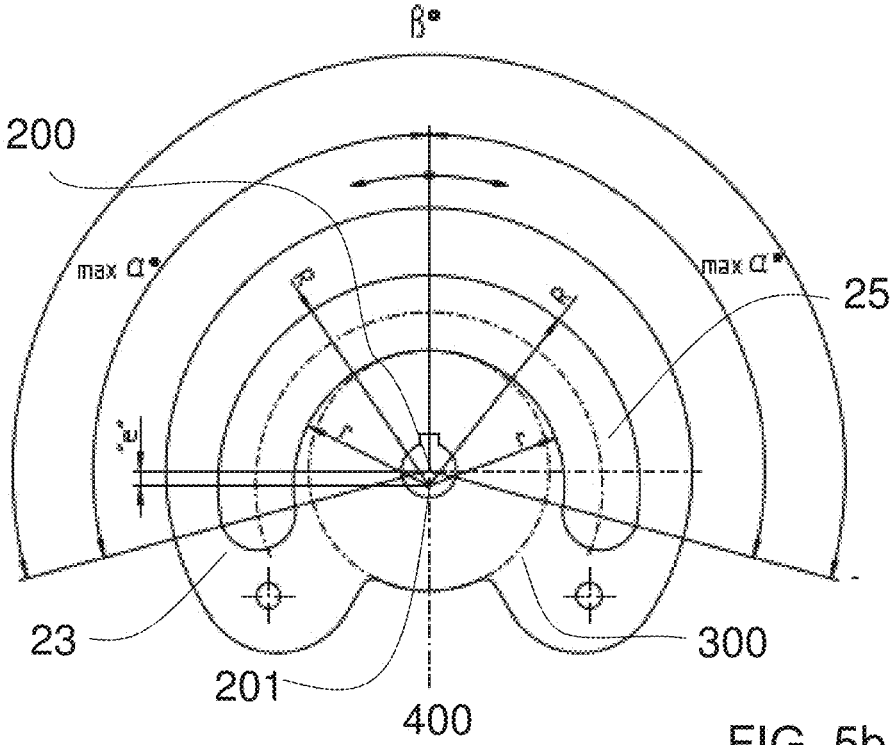
FIG. 5*b* shows a schematic representation of the cam gear of a second embodiment of the metering pump according to the invention.
Figure 6A:
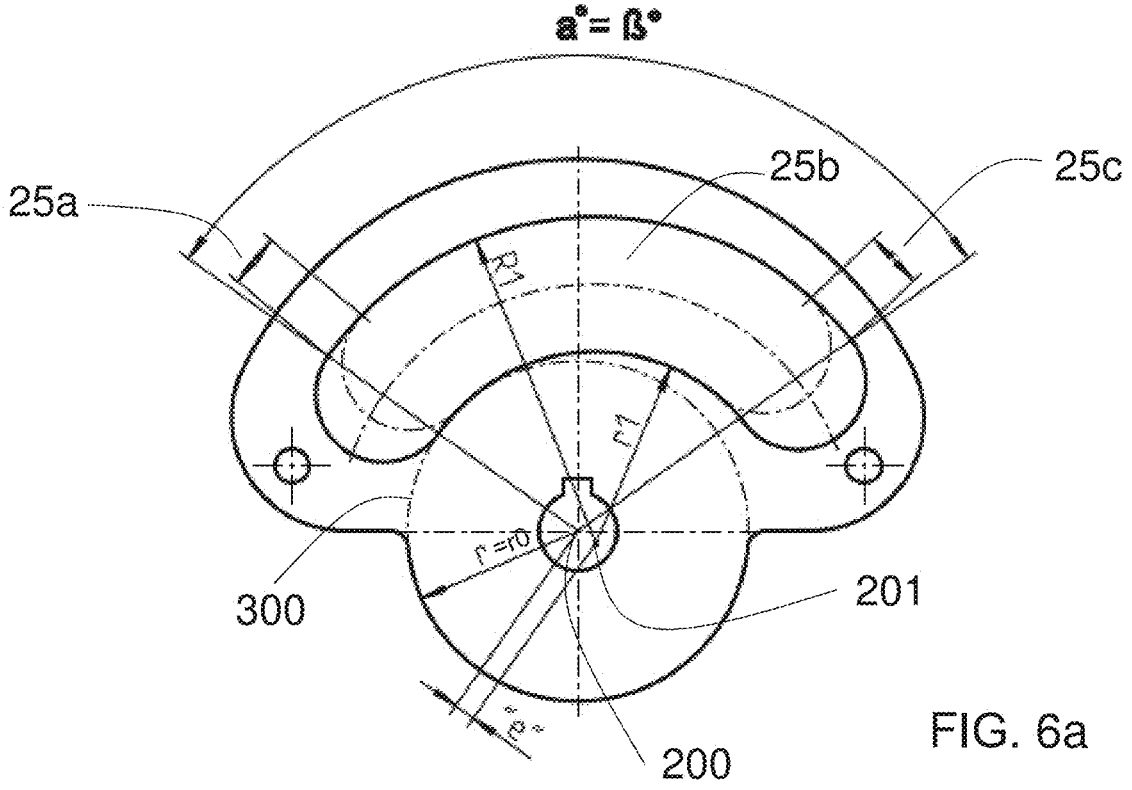
FIG. 6*a* shows a schematic representation of the cam gear of a third embodiment of the metering pump according to the invention.

The embodiment of the cam gear 23 shown in FIG. 5*b* differs from the embodiment shown in FIG. 5*a* essentially in the arc length $\beta$ of the groove 25, which allows a twist angle $\alpha$ of more than 180°. The groove 25 is also designed to be mirror-symmetrical about a mirror axis 400, so that the running surfaces 230, 231 at both ends of the groove 25 deviate from the circular path 300 by the same amount. The advantage of this longer groove 25 is that the roller 24 is loaded more evenly because a larger rotation occurs around the rotation axis 200. In addition, the deviation at both ends of the groove allows a full suction and pressure stroke of the displacement element 12 or the connecting rod 22 to be carried out during only one direction of rotation of the drive, thus reducing energy consumption, the load on the drive and the number of changes of direction. Another embodiment of the cam gear 23 is shown in FIG. 6*a*, wherein the groove 25 is characterized by different slopes. The groove 25 has three sections 25*a*, 25*b* and 25*c*, with the first section 25*a* and the third section 25*c* having a slope of, for example, 0, i.e. the radius r of the inner running surface 230 corresponds to the radius $r_0$ of the circular path 300, and the second section 25*b*, which is arranged in the circumferential direction the rotation axis 200 between the first and third sections 25*a*, 25*c* has a slope larger than 0, the inner running surface 230 of the section 25*b* being described by a circular path with a radius $r_1$, the center 201 of which deviates from the center of the circular path 300 by an amount e. Similarly, the outer running surface 231 is described by a circular path with a radius $R_1$ around the center 201.

Figure 6B:
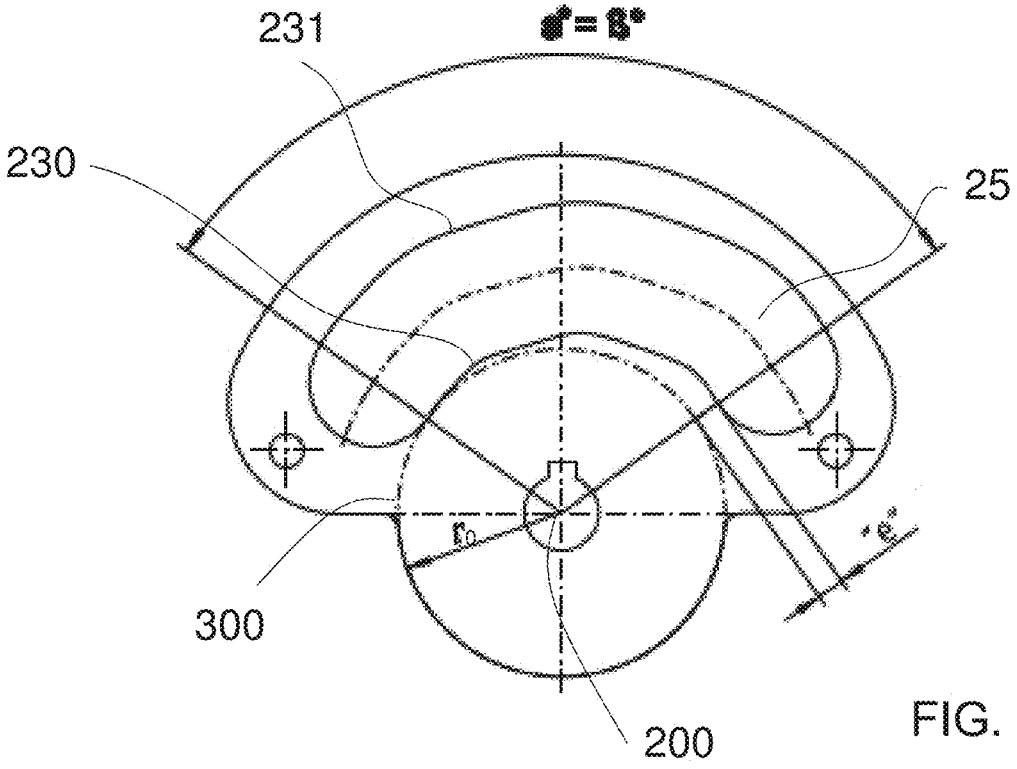
FIG. 6*b* shows a schematic representation of the cam gear of a fourth embodiment of the metering pump according to the invention.

FIG. 6*b* shows a further embodiment of the cam gear 23, in which the groove 25 has a free curve shape. In contrast to the previously described embodiments, the running surfaces 230, 231 of the groove 25 shown in FIG. 6*b* are not described by a circular path, but follow an arbitrary curve shape. For a twist angle $\alpha$, there is a deviation e from the circular path 300 around the rotation axis 200, which ultimately corresponds to the stroke length of the displacement element 12. The free curved shape is used to individually specify the movement profile of the displacement element 12, i.e. the speed, acceleration and deceleration of the suction and pressure stroke.

Figure 7:
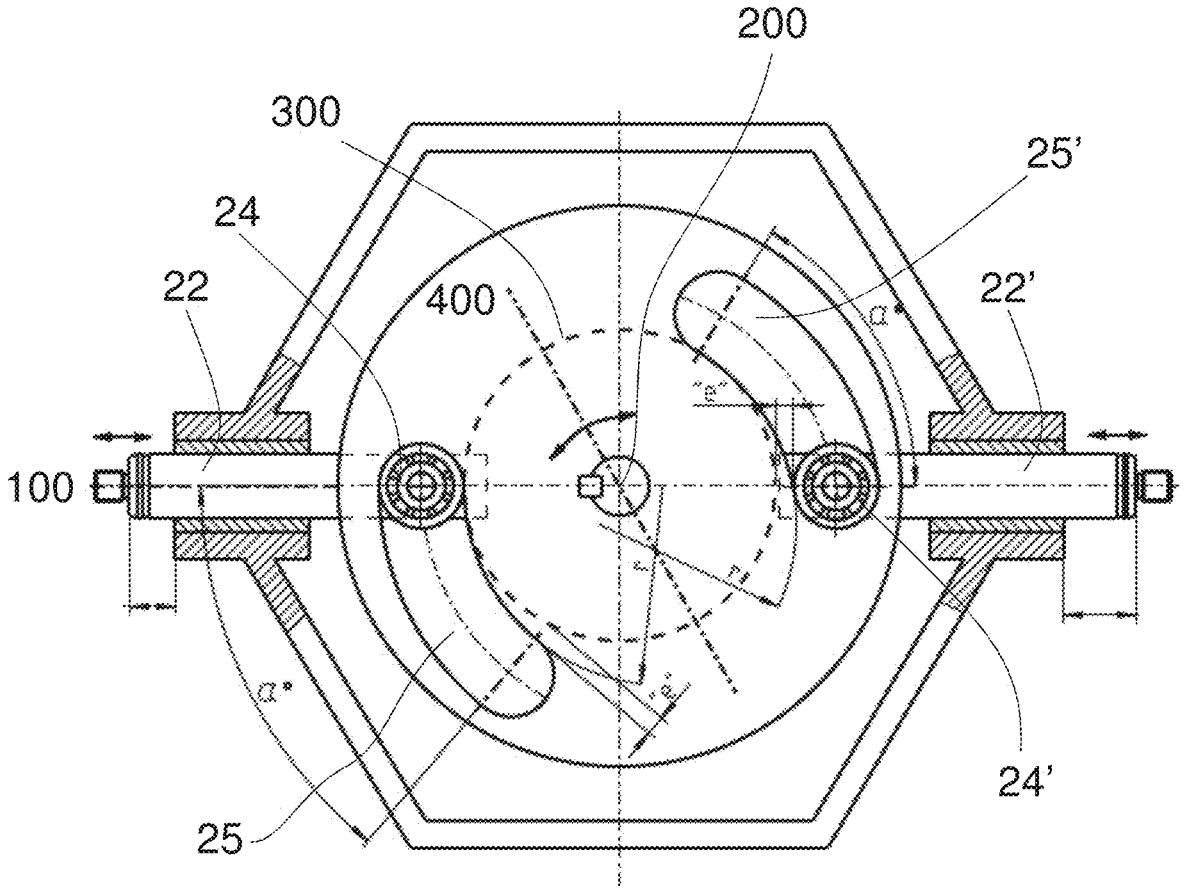
FIG. 7 shows a schematic representation of the cam gear of a fifth embodiment of the metering pump according to the invention.
Figure 8:
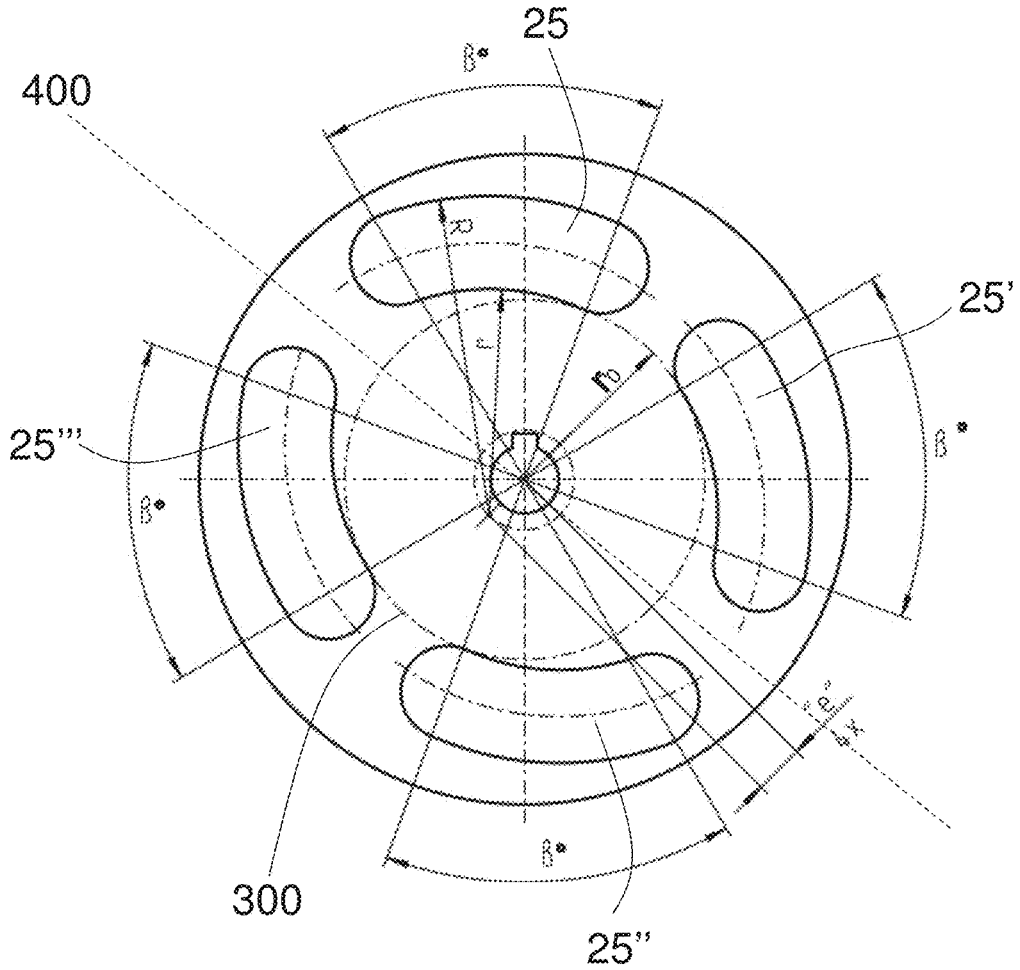
FIG. 8 shows a schematic top view of the drive unit of a sixth embodiment of the metering pump according to the invention.

In FIGS. 7 and 8, cam gears 23 with a plurality of grooves 25, 25', 25", 25''' are shown. All grooves have the same arc length β and running surfaces with the same curve shape, i.e. the deviation from the circular path 300.

The drive unit shown in FIG. 7 can be used to operate two metering heads simultaneously. FIG. 7 also shows that a roller 24, 24' is arranged in each of the grooves 25, 25', which is connected to a connecting rod 22, 22'. The connecting rods 22, 22' are in turn connected to displacement elements as shown in FIG. 1, whereby when the connecting rod 22 generates a pressure stroke in one metering head, the connecting rod 22' generates a suction stroke in the other metering chamber. For this purpose, the grooves 25, 25' of the cam gear 23 are arranged mirror-inverted at 180° to the rotation axis 200, i.e. mirror-symmetrically to the mirror axis 400, so that the connecting rods 22, 22' run in opposing cycles. This enables a particularly low-pulsation delivery characteristic to be achieved by the metering pump 1 according to the invention.

While two grooves are provided in FIG. 7, four grooves 25, 25', 25", 25''' are provided in FIG. 8, with the four grooves in FIG. 8 being arranged at 90° mirror-inverted to the rotation axis 200. This results in a mirror symmetry about a mirror axis 400, with the connecting rods, which are guided by rollers in adjacent grooves 25, 25', 25", 25''', running in opposing cycles. Four metering heads can be operated simultaneously with the drive unit shown in FIG. 8.

The advantage of the design of the metering pump 1 according to the invention is that both the stroke length of the displacement element 12 and the stroke frequency of the displacement element 12 can be set solely by the motor control, so that influence is exerted on the metering volume of the metering pump 1 according to the invention by means of two control variables. By deviating the running surfaces 230, 231 from a circular path 300 or by the variable curve shape of the running surfaces 230, 231 of the cam gear 23, any metering sequence can be set with the metering pump 1 according to the invention.

LIST OF REFERENCE SIGNS

1 metering pump
10 metering head
11 metering chamber
12 displacement element
13 fluid inlet
14 fluid outlet
20 drive
21 gear arrangement
22, 22' connecting rod
23 cam gear
24, 24' roller
25, 25', 25", 25''' groove
25*a* first section of the groove
25*b* second section of the groove
25*c* third section of the groove
26 reducing gear
100 movement axis
200 rotation axis
201 center of the curved running surface
230 inner running surface
231 outer running surface
300 circular path
400 mirror axis

The invention claimed is:

1. A metering pump (1) for delivering a metering volume of a fluid, comprising:

at least one metering head (10) in which a metering chamber (11) is arranged;

a displacement element (12) that can be moved back and forth between a first and a second position on a movement axis (100), wherein the displacement element (12) delimits the metering chamber (11), and a volume of the metering chamber (11) in the first position of the displacement element (12) is larger than the volume of the metering chamber (11) in the second position of the displacement element (12); and a drive (20) rotating about a rotation axis (200), wherein a rotational movement of the drive (20) about the rotation axis (200) is converted by a gear arrangement (21) into an oscillating movement of a connecting rod (22) during operation of the metering pump (1), the connecting rod (22) being connected to the displacement element (12) in such a way that the displacement element (12) is moved back and forth between the first and the second position along the movement axis (100), wherein, during operation of the metering pump (1), the drive (20) performs a pendular movement with a twist angle of $\alpha<360°$ and a frequency of f, and the gear arrangement (21) comprises a cam gear (23) that is arranged on the rotation axis (200) and has a curved running surface (230, 231) that deviates at least in sections from a circular path (300) around the rotation axis (200), wherein the connecting rod (22) rolls over a roller (24) on the running surface (230, 231), so that a stroke length of the displacement element (12) is determined by the twist angle α and a slope of the running surface (230, 231), and a stroke frequency of the displacement element is determined by the frequency f, wherein the curved running surface comprises a plurality of curve sections, and wherein at least one of the curve sections is defined by a circular arc having a center offset relative to the rotation axis.

2. The metering pump (1) according to claim 1, where the following applies to the twist angle: $\alpha \leq 180°$.

3. The metering pump (1) according to claim 1, wherein the curved running surface (230, 231) has different slopes.

4. The metering pump according to claim 1, wherein a slope of the curved running surface is constant, wherein the curved running surface is optionally defined by a circular path around a center, wherein the center differs from the rotation axis.

5. The metering pump (1) according to claim 1, wherein the cam gear (23) is designed as a disc, wherein the disc has a groove (25) that comprises the curved running surface (230, 231), so that the connecting rod (22) is guided in the groove (25) vithe roller (24), the groove (25) optionally being closed.

6. The metering pump according to claim 5, wherein an are length of the groove is defined by an opening angle β around the rotation axis, wherein $\alpha \leq \beta$.

7. The metering pump (1) according to claim 1, wherein the curved running surface (230, 231) has at least two sections (25*a*, 25*b*), optionally three sections (25*a*, 25*b*, 25*c*), wherein at least in each case two sections of the curved running surface (23 0, 231) have a different slope.

8. A metering pump (1) for delivering a metering volume of a fluid, comprising:

at least one metering head (10) in which a metering chamber (11) is arranged;

a displacement element (12) that can be moved back and forth between a first and a second position on a movement axis (100), wherein the displacement element (12) delimits the metering chamber (11), and a volume of the metering chamber (11) in the first position of the displacement element (12) is larger than the volume of the metering chamber (11) in the second position of the displacement element (12); and a drive (20) rotating about a rotation axis (200), wherein a rotational movement of the drive (20) about the rotation axis (200) is converted by a gear arrangement (21) into an oscillating movement of a connecting rod (22) during operation of the metering pump (1), the connecting rod (22) being connected to the displacement element (12) in such a way that the displacement element (12) is moved back and forth between the first and the second position along the movement axis (100), wherein, during operation of the metering pump (1), the drive (20) performs a pendular movement with a twist angle of $\alpha<360°$ and a frequency of f, and the gear arrangement (21) comprises a cam gear (23) that is arranged on the rotation axis (200) and has a curved running surface (230, 231) that deviates at least in sections from a circular path (300) around the rotation axis (200), wherein the connecting rod (22) rolls over a roller (24) on the running surface (230, 231), so that a stroke length of the displacement element (12) is determined by the twist angle $\alpha$ and a slope of the running surface (230, 231), and a stroke frequency of the displacement element is determined by the frequency f, and wherein a slope of the running surface is selected such that for a movement of the connecting rod along the movement axis of $h_1=1$ mm, a slope angle $$\alpha_{h1} = \frac{\alpha}{h1}$$

is between 5° and 360°, and optionally $8°\leq\alpha_{h1}\leq 90°$.

9. The metering pump according to claim 5, wherein the disc has a plurality N of, optionally closed, grooves (25, 25', 25", 25'"), each comprising a curved running surface that deviates, at least in sections, from a circular path around the rotation axis, wherein N={2, 3, 4}, and wherein the grooves are arranged around 360°/N in a mirror-inverted manner with respect to the rotation axis.

10. The metering pump according to claim 9, the metering pump comprising a plurality of metering heads, each with a metering chamber and a displacement element, wherein a plurality M of connecting rods (22, 22') is provided, wherein one displacement element in each case is connected to one of the grooves via a respective connecting rod.

11. The metering pump according to claim 1, wherein the drive is a controllable drive.

12. The metering pump according to claim 1, wherein the gear arrangement has a reducing gear (26) that is arranged between the drive and the cam gear.

13. The metering pump according to claim 1, wherein at least one running surface (230, 231) of the cam gear is coated with a sliding coating.

14. A metering process for conveying a metering volume of a fluid, comprising:

obtaining the metering pump according to claim 1; and operating the metering pump, wherein the rotating movement of the drive is converted by means of the gear arrangement into a stroke movement of the displacement element, wherein the rotating movement of the drive is the pendular movement with the twist angle $\alpha<360°$ and the frequency f, and the gear arrangement comprises the cam gear that is arranged on the rotation axis of the drive and has the curved running surface that deviates at least in sections from the circular path around the rotation axis, wherein the connecting rod rolls over the roller on the running surface, and wherein the connecting rod is connected to the displacement element in such a way that the stroke length of the displacement element is determined by the twist angle $\alpha$ and the slope of the running surface, and the stroke frequency of the displacement element is determined by the frequency f.

15. A metering process for conveying a metering volume of a fluid, comprising:

obtaining the metering pump according to claim 8; and operating the metering pump, wherein the rotating movement of the drive is converted by means of the gear arrangement into a stroke movement of the displacement element, wherein the rotating movement of the drive is the pendular movement with the twist angle $\alpha<360°$ and the frequency f, and the gear arrangement comprises the cam gear that is arranged on the rotation axis of the drive and has the curved running surface that deviates at least in sections from the circular path around the rotation axis, wherein the connecting rod rolls over the roller on the running surface, and wherein the connecting rod is connected to the displacement element in such a way that the stroke length of the displacement element is determined by the twist angle $\alpha$ and the slope of the running surface, and the stroke frequency of the displacement element is determined by the frequency f.

16. The metering pump according to claim 1, wherein a slope of the running surface is selected such that for a movement of the connecting rod along the movement axis of $h_1=1$ mm, a slope angle $$\alpha_{h1} = \frac{\alpha}{h1}$$

is between 5° and 360°, and optionally $8°\leq@h_1\leq 90°$.

17. The metering pump according to claim 1, wherein the plurality of curve sections of the curved running surface (230, 231) comprise a first section (25*a*), a second section (25*b*), and a third section (25*c*), wherein the second section (25*b*) is arranged in a circumferential direction with respect to the rotation axis (200) between the first section (25*a*) and the third section (25*c*), and wherein each of the first section (25*a*) and the third section (25*c*) has a smaller slope than that of the second section (25*b*).

* * * * *